United States Patent [19]

Brown

[11] 4,395,850

[45] * Aug. 2, 1983

[54] ADAPTER DEVICE FOR TOOLS OF AN ABRASIVE BLASTING SYSTEM

[75] Inventor: Donald J. Brown, Naperville, Ill.

[73] Assignee: JPD Manufacturing Limited, Itasca, Ill.

[ * ] Notice: The portion of the term of this patent subsequent to Nov. 11, 1997, has been disclaimed.

[21] Appl. No.: 203,717

[22] Filed: Nov. 3, 1980

Related U.S. Application Data

[63] Continuation-in-part of Ser. No. 909,537, May 25, 1978, Pat. No. 4,232,487.

[51] Int. Cl.[3] ..... B24C 5/04

[52] U.S. Cl. ..... 51/427; 51/439

[58] Field of Search ..... 51/424, 425, 427–429, 51/438, 439

[56] References Cited

U.S. PATENT DOCUMENTS

| | | | |
|---|---|---|---|
| 2,597,434 | 12/1948 | Bishop et al. | 51/438 X |
| 2,628,456 | 2/1953 | Berg | 51/424 |
| 2,723,498 | 11/1955 | Hastrup et al. | 51/427 X |
| 2,770,924 | 11/1956 | Mead et al. | 51/427 |
| 2,810,991 | 10/1957 | Mead et al. | 51/427 X |
| 3,624,967 | 12/1971 | Kamper et al. | 51/425 X |
| 3,906,673 | 9/1975 | Goto et al. | 51/425 X |
| 3,934,372 | 1/1976 | Diehn et al. | 51/425 |
| 4,045,915 | 9/1977 | Gilbert et al. | 51/427 |
| 4,232,487 | 11/1980 | Brown | 51/425 |

*Primary Examiner*—James G. Smith

*Attorney, Agent, or Firm*—Wood, Dalton, Phillips, Mason & Rowe

[57] ABSTRACT

A surface treating adapter device for use in combination with a recirculating abrading device includes an adapter housing affording a hollow cup-shaped chamber, an aperture in the housing to receive the discharge nozzle of an abrasive gun, an exhaust outlet including means for detachably engaging a low pressure line from the abrading device, interchangeable hollow working tool members, and tubular connecting members releasably and adjustably joining the adapter housing and a selected one of the tool members. The tool members which contact the surface to be abraded are each of varying configuration for accommodating surfaces of varying contour and for making a sealing engagement therewith. The abrading operation is performed within the confines of the tool member being used. Abrasive is introduced through the housing aperture and impinges upon the surface area enclosed by the tool member. The scale and debris, including the spent abrasive, are then drawn through the chamber of the housing and through the exhaust outlet to the abrading device, and there separated.

7 Claims, 23 Drawing Figures

103
101d
8.
106d
90d
110d
108d
120
121
8.

101d
121
120

106d
90d
103
110d
108d 110e
110e
10.
103
90e
108e
124
106e
10.

110e 108e
90e
103
124
101e
106e 101f
103
127
12.
110f
126
12.
106f
90f
126
108f
127

103
106f
90f
110f
126
127
13.
13
108f
101f 90f
127
108f
126

103
90g
133
110g
15.
132
130
131
101g
108g
106g
131
130
15.

106g
90g
133
132
103
108g
131
101g
130

ADAPTER DEVICE FOR TOOLS OF AN ABRASIVE BLASTING SYSTEM

CROSS-REFERENCE TO RELATED APPLICATION

This application is a continuation-in-part of my copending application Ser. No. 909,537, filed May 25, 1978, entitled ABRADING DEVICE, now U.S. Pat. No. 4,232,487.

BACKGROUND OF THE INVENTION

1. Field of the Invention

The invention relates to surface treating apparatus and more specifically to an adapter device having a housing through which abrasive is introduced and exhausted by an external source, the adapter device being used with a selected one of a number of interchangeable surface contacting tools detachably mounted upon the housing.

SUMMARY OF THE INVENTION

Specifically the invention relates to an accessory for the above abrading device which comprises a housing containing a supply of abrasive material and having an outlet at the bottom thereof, a source of vacuum connected to the housing and applying a negative pressure to the upper surface layer of said abrasive material, a gun having a barrel for directing abrasive material in the direction of a surface area to be abraded and having a passageway therethrough, a source of positive pressure air connected to one end of said gun passageway, a first conduit connected to the housing above said abrasive material for returning abrasive material and abraded debris to the housing, a second conduit having a first end portion connected to the housing outlet and a second end portion connected to said gun passageway downstream of the connection of said source of positive pressure to said gun, and means for causing abrasive material to flow toward the gun in said second conduit.

In an exemplary embodiment of the invention, the adapter device comprises a peripheral sidewall with an enclosed rear end wall which form a housing having an inner cup-shaped chamber. An aperture is formed within the rear end wall to accommodate a gun nozzle for pivotal or swinging movement. An exhaust outlet is provided in the housing and includes a fitting to detachably engage the first conduit through which spent abrasive and debris are returned to the abrading device. Interchangeable hollow tool members are each adapted for adjustable connection to the adapter housing and the abrading operation is carried out, and is confined to, the interior of the tool members and the interior chamber of the adapter housing.

Each tool member comprises a hollow body, with oppositely facing open ends, aligned axially with the mounting adapter chamber. Tubular connecting members on the housing and on each tool member releasably and adjustably mount each tool member in operative working position. The forward end portion of each tool member includes a peripheral seal member appropriately shaped to engage the contour of the surface to be abraded. The tool members each have varying frontal configurations so as to accommodate surfaces of varying contour and surfaces of varying locations.

It is the principal object of the present invention to provide an adapter device through which adrasive may be introduced by and recycled to the abrading device, as well as providing a mounting base upon which a variety of interchangeable surface contacting adapter tools may be fitted.

It is a further object of the present invention to provide a number of interchangeable working tool members to be detachably connected to the housing of the adapter device, each tool member having a varying configuration in its forward exposed sealing edge of the tool members to afford a close engagement with surfaces of varying contours, e.g. including inwardly directed and outwardly directed corners, edges and offset edges, whereby abrasive may be precisely directed against the surface to be abraded while protecting adjacent surfaces from abrasion.

It is a further object of the invention to provide tubular connecting members for releasably and adjustably connecting each tool member to the housing of the adapter device, thereby permitting the exhaust outlet to be at all times directed downwardly so that the gravitational forces augment the collection accomplished by the low pressure region within the retrieval line.

It is still a further object of the invention to provide an improved surface contacting seal at the open forward edge of each tool which seal incorporates an inner shield to protect the surface engaging seal from abrasion.

It is an overall object of the invention to provide a portable air-tight enclosure within which an abrading operation may be performed and wherein abrasive can be introduced and propelled against a variety of surface contours and be recollected by the abrading device without the expulsion of either the abrasive or debris into the atmosphere.

BRIEF DESCRIPTION OF THE DRAWINGS

The details of construction and operation of the invention are made fully described with reference to the accompanying drawings which form a part hereof and in which like reference numerals refer to like parts throughout.

In the drawings.

DESCRIPTION OF THE PREFERRED EMBODIMENTS

Figure 1:
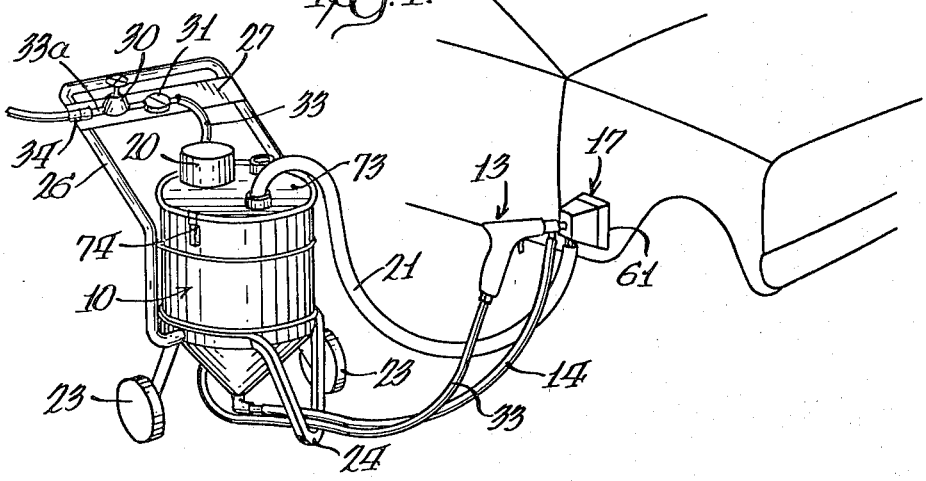
FIG. 1 is a perspective of an embodiment of the abrading device of the invention and illustrates its use on an automobile fender.
Figures 2, 3:
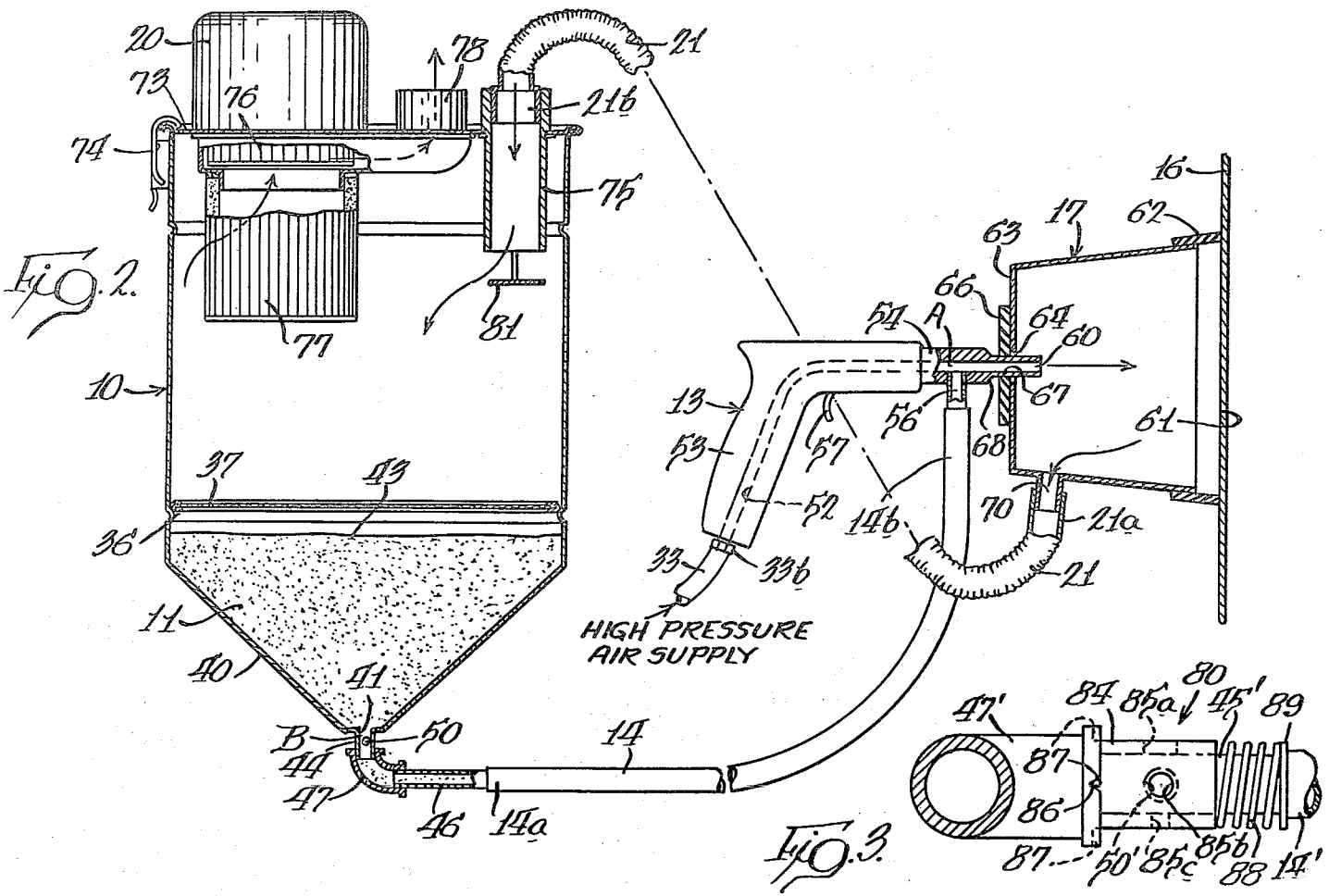
FIG. 2 is a fragmentary, side elevational view of the invention, partially in cross section, illustrating the flow of the abrasive material.
FIG. 3 is a top elevational view of a variable aperture which may be used in connection with the present invention.

Referring to FIGS. 1 and 2, an abrasive surface treating apparatus is seen to generally include a housing or cannister 10 providing an internal reservoir for abrasive material, such as sand 11, a gun 13 for propelling said delivered through a supply conduit 14 against a work surface 16, a shroud or working tool member 17 for capturing used sand and debris, and a vacuum motor 20 for withdrawing sand from the stroud 17 through a retrieval conduit 21 so that spent sand is returned to the interior of the cannister 10. It is understood that while sand of different sizes or grits may be used as the abrasive material, other materials may also be utilized, such as garnet granules, glass beads, ground corn cobs, or crushed nut shells.

As seen in FIG. 1, the cannister 10 is supported by a frame which includes a pair of rear wheels 23, a front leg 24, and a rearwardly extending roughly U-shaped handle 26. Secured to a cross member 27 fixed across the handle 26 are a pressure regulating valve 30 and a pressure gauge 31 which are connected along a pressurized air conduit line 33, the valve 30 varying the velocity of the pressurized air in the conduit line 33. The upstream air end 33*a* of the air conduit 33 is joined by way of a quick disconnect nipple and connector coupling 34 to an external air supply providing air under high pressure. When not in use, the flexible hose lines making up the conduits 14, 21 and 33 may be wrapped about the cylindrical exterior of the cannister 10 inside of the handle parts.

The cannister 10 has an annular inside rib 36 which provides support for a screen 37. The screen 37 separates out any particles that may be too large for the line 14 leading from the bottom of the cannister 10 to the gun 13. The bottom wall 40 of the cannister 10 is preferably hoppershaped to funnel sand within the interior of the cannister 10 downwardly toward an outlet 41 which is at the bottom center thereof. The sand 11 has a depth thickness which is maintained within a range to provide a pressure barrier, the depth being dependent on the diameter of the cannister and the type of abrasive employed. The sand 11 in the reservoir has an upper surface layer 43 which is maintained at a height relatively close to the bottom of the screen 37.

Extending vertically downward from the outlet 41 is an outlet tube 44 defined by the cannister housing which is connected to a generally horizontally oriented second tube 46 by way of an elbow fitting 47. It is understood that this outlet structure may be integrally constructed, if desired. An aperture 50 is defined in the outlet tube 44, preferably spaced approximately one inch from the outlet 41 and, for the example illustrated, has a diameter of approximately 3/16 inch. The purpose of the aperture 50 will be described hereafter. The upstream end 14*a* of the sand supply line 14 is connected to the tube 41.

The gun 13 has a passageway 52 which extends through its hand grip 53 and its barrel 54. The downstream end 33*b* of the air pressure hose 33 is connected to the hand grip and of the passageway 52. The barrel 54 is provided with an inlet tube 56, preferably approximately 5/16 inch in diameter, which makes a T-connection with the downstream end of the passageway 52. The downstream end 14*b* of the sand supply line 14 is operatively connected to the tube 56.

The gun 13 is provided with a trigger 57 which is connected to conventional means (not shown) for admitting or shutting off the flow of pressurized air to the barrel 54. The trigger 57 may either operate a valve within the gun 13 or operate a solenoid which turns on or shuts off the external pressure source itself. When the trigger 57 is actuated, rapidly flowing air under pressure is directed to the passageway 52 through the barrel 54 and out the open end 60 of the gun. The air in the passageway 52 moving rapidly over the open end of the inlet tube 56 creates a low pressure point or space at A so that sand is drawn through the supply line 14 and is caused to enter the passageway 52. The sand is then carried along by the rapidly moving air, out of the gun at 60 and against the work surface area 16.

The shroud 17 is a cup-shaped enclosure for recapturing sand which has been propelled against the surface area enclosed by the shroud. The shroud 17 prevents sand and debris from being dispersed into the ambient air. As shown in FIGS. 1 and 2, the four sides of shroud 17 are trapezoidal, and the shroud has a forward end 61 which faces the work surface with an open area that may be, for instance, about eight inches across. Disposed about the periphery of the shroud 17 at its forward end is a resilient rubber seal 62 which provides a closely fitting seat with the work surface 16. Since the interior of the shroud 17 is maintained at a pressure below atmosphere, any leakage between the seal 62 and the work surface 16 will result in atmospheric air being drawn into the shroud 17. The flow of air around the shroud edges will be effective in containing sand and debris within the interior of the shroud.

The rear wall 63 of the shroud defines an aperture 64 through which the barrel 54 of the gun is inserted. The aperture 64 is of such size that a fairly close fit is made with the barrel, but permits the gun to be moved pivotally so that it can be directed downwardly, upwardly or sidewardly to control the direction in which the sand is propelled against the work surface. In order to prevent the leakage of air through the aperture 64 between the gun barrel 54 and the shroud 17, a resilient seal 66 is fixed to the exterior of the rear wall 63 of the shroud. The resilient seal 66 has an aperture 67 which is aligned with the aperture 64 in the rear wall and is of such size that it makes a tight fit with the barrel 54 of the gun. As a result, leakage of air is minimized through the shroud aperture 64. The gun barrel 54 defines a beveled shoulder 68 which may be urged by the user against the seal 66 partially into the aperture 64 to further insure a tight seal. Thus, sand may be directed at high velocity from the barrel of the gun against the work surface area and the gun can be swiveled so that sand can be made to impinge upon all of the work surface within the confines of the shroud 17. Formed at the bottom of the shroud 17 is an opening defined by an outlet tube 70 to which the upstream end 21*a* of the sand retrieval line 21 is detachably connected.

The vacuum motor 20 is mounted on the cannister lid 73 which seals the top of the cannister 10 and may be removed therefrom by releasing lock members 74. The sand retrieval line 21 is detachably connected to the cannister 10 by inserting its downstream end 21*b* into an inlet tube 75 extending through the lid 73. The vacuum motor 20 drives a fan element 76 which draws air from the interior of the cannister 10 through a removable filter bag 77 and exhausts it externally via an outlet 78. Thus, the interior of the cannister 10 above the sand 11 is evacuated so that the pressure therein is substantially less than atmospheric. Consequently, spent sand and debris removed from the work surface will be drawn into the cannister 10 from the shroud 17 through the retrieval line 21.

The size of the cannister and the type of vacuum motor of the present invention may generally correspond to that of the ordinary wet-dry type of shop vacuum which frequently is used in small shops to clean up debris.

A plastic deflector 81 is provided within the interior of the cannister 10 to slow down the rapidly moving sand and dust that has entered the interior of the cannister. While the lighter particles are drawn to the filter bag 77, the heavier sand particles drop by gravity to the bottom of the cannister. The sand will then pass through the screen 37 and fall onto the top of the sand pile 11 to replenish the sand pile and maintain the depth of the sand pile. This sand may then be reused by redirecting it to the gun.

The filter bag 77 filters any debris coming in from the sand retrieval line 21 which is of a size and weight to become airborne so that dust and small particles will not be discharged out into the ambient air. Any dust or particles which are airborne come within the influence of the evacuating motor 20 and are gathered within the interstices of the filter bag 77. The filter bag 77 may be replaced when heavily laden with dust and dirt by removing the lid 73. It is understood that the filter bag may be located externally of the housing so that dust and small particles are directed out of the outlet 78 into such an external bag.

In operation, the apparatus establishes a complete circuit for flow of abrading material from the reservoir within the cannister to the blasting gun and to the work surface and from the work surface back to the top of the reservoir within the cannister so that the abrading material can be reused. Importantly, the device can be used in an enclosed shop without the necessity of a special discharge line to the exterior air outside the shop.

Because of the structural and functional features included in the present invention, abrasive flowing from the cannister through the abrasive conduit to the gun is metered into a uniform and even flow, which flow of abrasive can be varied in amount per unit time even during operation of the invention. Furthermore, the unique features included herein enable the device to be operated satisfactorily throughout a large range of operating pressures in the gun (e.g., from 30 pound per square inch to 90 pounds per square inch) so that the eroding action of the abrasive on the working surface can be controlled in accordance with the nature of the material of that surface upon which work is being performed. Importantly also, this abrading device thus accommodates itself to a wide range of air compressor capacities which may be found in small shops where the device may be used.

Within the system, pressures are maintained at levels less than one atmosphere. Pressures below atmospheric exist within the gun 13 at A, within the outlet tube 44 at B, within the shroud 17, and within the cannister 10 above the sand pile 11. The sand supply line 14 is at low pressure because of the high velocity current of air within the passageway 52 moving across the end of sand inlet tube 56, while the sand retrieval line 21 is at low pressure because of the vacuum created in the cannister 10 by the vacuum motor 20.

Because the interior of the shroud 17 during operation is kept at low pressure by the vacuum within sand retrieval line 21, extremely turbulent action is imparted to the sand. The initial velocity of the impinging sand upon the surface of the work and the extremely turbulent action of the sand within the shroud enhance the cleaning action upon the surface of the work. In addition, because of the low pressure within the shroud 17, atmospheric pressure urges the shroud against the work surface 16.

The aperture 50 renders the upstream end 14*a* of the sand supply line 14 open to atmosphere and causes a quantity of sand to be set in motion and flow through the supply line 14 from the reservoir to the gun 13. The level of sand is maintained at an appropriate level to provide a barrier or separating medium. In the illustrated embodiment, satisfactory results have been obtained by providing about six inches of sand between the low pressure area within the cannister above the sand and the low pressure area in the outlet 41 below the sand at B, although this depth may be varied depending upon the granular nature of the abrasive, the volume of the cannister, and the size and exhausting capabilities of the vacuum motor 20. The barrier sand at the bottom of the cannister 10 permits the creation of a lower pressure in the supply line 14 by air pressure through the gun and by ingress of air through aperture 50 than the vacuum motor 20 can create in the lower part of the sand 11 near the outlet 41. A barrier of insufficient depth will permit air to be pulled upwardly through the sand and to the top of the reservoir against the forces created within the supply line 14 at the outlet 41.

When the aperture 50 is open and the valve in the gun is open, incoming atmospheric air flows from the aperture toward the gun 13 and the venturi or siphon effect generated at B pulls the sand 11 into the supply line 14 and, with the stream of air, the sand flows toward the gun. While mention is made of the sand being pulled, it is understood that air flows from a zone of high pressure toward a zone of lower pressure so that the sand is forced or pushed by air flowing in this manner.

The function of the aperture 50 can be better understood by noting that if the aperture 50 was closed entirely and the cannister 10 was being evacuated, very little sand would flow through the sand supply conduit 14 to the gun when air under pressure was delivered through the gun passageway 52 across the end of the sand supply line 14. When the device is rendered completely inoperative, some sand falls by gravity through the outlet 41 in the bottom of the cannister hopper. When the vacuum motor is turned on to evacuate air from the cannister above the top surface of the sand and from the shroud 17, but no air pressure is delivered through line 33 to the gun 13, atmospheric air from the aperture 50 will be pulled upwardly through the outlet 41 and the abrasive 11 so that abrasive which might have fallen by gravity into the outlet 41 will, in large measure, be pulled back up into the outlet tube 44 and into the cannister 10. Similarly, abrasive which is in conduit 14 will be returned or moved past the fitting 47 and the aperture 50 to the reservoir for abrasive in the cannister. It should be noted that the height of the sand barrier may be substantially greater than six inches, depending upon the factors pointed out above. However, since the device is intended to be lightweight and portable for indoor use and since a large reservoir of abrasive is not required because the abrasive is continuously recirculated, an excessive amount of abrasive is not required within the cannister 10.

The function of aperture 50, and of varying sizes of such apertures, has been studied utilizing a transparent plastic abrasive supply line 14. Under conditions established with the aperture 50 completely closed, the motor 20 activated to evacuate shroud 17 through abrasive retrieval conduit 21, and the high pressure air flowing through air supply line 33 and gun 13, the abrasive 11 initially generally moves a short distance into the supply line 14 until the sand 11 substantially totally plugs the sand conduit 14. With increased air pressure at the gun, the sand tends to move farther down the conduit, but the conduit still remains substantially plugged. Occasionally a portion of the sand nearest the gun will break off and pass down the conduit, through the gun and against the working surface; however, this minor flow of sand is erratic, it is uneven and non-uniform, and it is unsatisfactory in performing an abrading operation. It is believed that the line 14 plugs because a kind of pressure balance is established between low pressure zones in conduit 14 and in the cannister 10 above the abrasive 11, and because of the absence of a flow of air to propel the abrasive through conduit 14. When the aperture 50 is opened under the above conditions, the ambient air moves rapidly through the aperture 50, through the tortuous maze of air flow passages between adjacent granules of abrasive, and toward the low pressure zone within conduit 14 caused by the air pressure flowing within gun 13. This flow of air through aperture 50 rapidly unplugs conduit 14 and uniformly carries the sand from the reservoir, through conduit 14 to the gun 13. As observed through the transparent supply line 14, for a satisfactory abrading operation the supply line is not completely filled with abrasive, but rather a much smaller quantity of abrasive forms a uniform stream of spaced abrasive granules and is carried along in the flow of air from aperture 50.

By using varying sizes of apertures 50, the rate of flow of air through conduit 14 can be controlled which in turn controls the rate of flow and the amount of abrasive 11 being delivered to the gun by the air flow. In other words, the abrasive flowing from the reservoir can be metered and varied as to quantity of abrasive flow to adapt the device to the particular exigencies of a given abrading operation to be performed. Additionally, this adjustability provided by variable sized apertures 50 enables the utilization of a wide range of air pressures at the gun 13 to control the velocity of the abrasive impinging upon the work surface so that the eroding action at the surface can be varied in accordance with the nature of the material of the surface and the desired effect to be produced upon the surface.

After an abrading operation when the pressure to the gun is shot off, some circulating abrasive initially remains in the abrasive conduit 14. However, with the aperture 50 above the elbow fitting 47, and with the upper portion of the cannister 10 being evacuated, the abrasive in the conduit 14 is almost immediately returned past the fitting 47 and the aperture 50 to the sand 11 within the cannister, thus clearing abrasive from the conduit 14.

Referring to FIG. 3, a metering mechanism 80 is illustrated positioned downstream of the elbow fitting 47 and connected to the upstream end of the conduit 14. Such a metering mechanism may also be employed above the fitting 47, if desired.

The structure of metering mechanism 80 provides for selective adjustment of the effective size of aperture 50' to fit the particular needs of a given abrading operation. As seen in FIG. 3, the aperture 50' is formed in the top of the horizontal tube 45'. A sleeve 84 having a plurality of different sized apertures 85*a*, 85*b* and 85*c* spaced circumferentially is disposed about the tube 45'. The tube aperture 50' preferably has a diameter of about 3/16 inch, while the sleeve apertures 85*a, b* and *c*, respectively, preferably measure about 3/16, 5/32 and 3/32 inches. The sleeve 84 may be rotated to selectively align one of the apertures 85*a, b* or *c* with the tube aperture 50' to change the effective area thereof. To locate and maintain alignment of the sleeve 84 on the tube 45', the sleeve 84 has a pin 86 which engages one of the slots 87 formed in the shoulder of the elbow fitting 47'. A spring 88 bears against a fixed collar 89 on line 14' and urges the sleeve 84 and pin 86 in axial engagement with a selected slot 87. By adjusting the size of the aperture communicating into line 14', the rate of flow of the sand can be controlled. The variable aperture also accommodates suitable adjustments for different types of abrasive material.

Again, the weight or quantity of abrasive can be varied and controlled by varying the size of the aperture in the metering mechanism 80 so as to adapt the device of the present invention to the needs of the particular abrading operation being performed in accordance with the nature of the material of the surface to be abraded and the desired effect to be produced upon the surface.

After an abrading operation utilizing metering mechanism 80, when the pressure to the gun 13 is shut off, some circulating abrasive initially remains in the abrasive conduit 14. However, the balance of pressure in this situation described above is such that the line or conduit 14 is almost immediately cleared to the shroud 17 and back to the top of the cannister 10, rather than as was the case with aperture 50 above the fitting 47. This clearing of conduit 14 to the shroud 17 is believed to be a function of the additional barrier of abrasive upstream of the aperture 50' and the positioning of the aperture 50' downstream of the elbow fitting 47.

Figure 4:
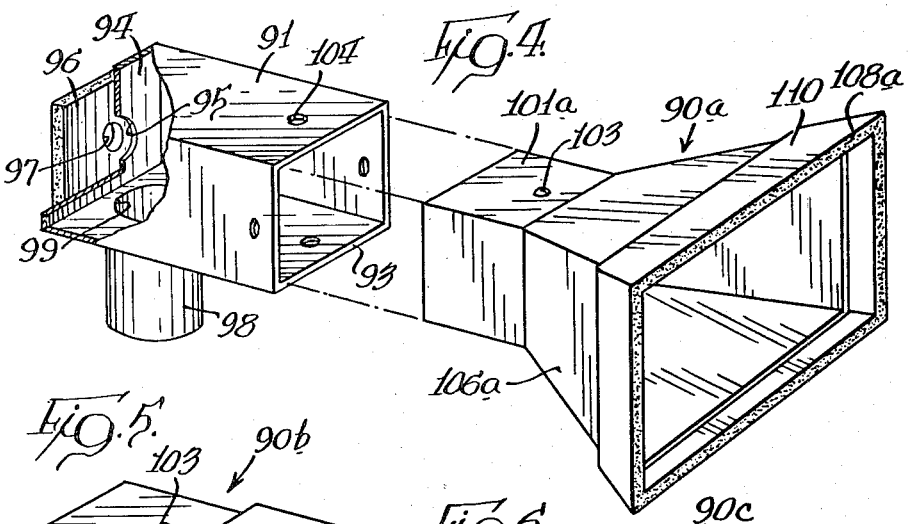
FIG. 4 is an exploded, perspective view of a shroud construction, partially in cross section, showing an adapter to which one type of shroud may be attached.
Figure 5:
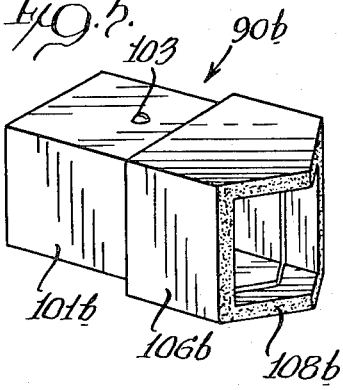
FIG. 5 is a perspective view of another type of stroud which may be employed with the adapter.
Figure 6:
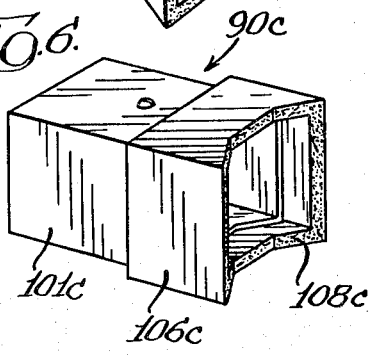
FIG. 6 is a perspective view of yet another type of shroud which may be used with the adapter.

In FIGS. 4–6, alternative constructions for the shroud or tool member are shown and permit convenient optional selection of differently configured tool members, generally designated 90*a*, 90*b* and 90*c*, and of other tool members which will be later described.

Referring to FIG. 4, in order to releasably and adjustably mount each tool member, an adapter device 91 is provided having a rigid hollow housing formed by a peripheral sidewall closed by a rear end wall 94 to afford a cup-shaped inner chamber. The rear end wall has a gun receiving aperture 95. A rubber element 96 is secured to the rear end wall 94 and has an opening 97 in alignment with aperture 95 and smaller than aperture 95 so as to snugly seal about the gun barrel when inserted through end wall 94.

An outlet tube 98 is located in a sidewall at the bottom of the housing of the adapter device 91 and defines an opening 99 through which spent abrasive and debris are retrieved by conduit 21 which is adapted for attachment to outlet means 98.

The tool member 90*a* has a hollow main body 106*a* with oppositely facing open ends and is adapted to be positioned in axial alignment with the inner chamber of the adapter device 91. The forward end of the main body of tool 90*a* has a peripheral resilient seal member 110, preferably of rubber, secured thereto, and a forwardly projecting exposed edge 108*a* of seal member 110 is shaped to engage the contour of a surface to be abraded in substantially air-tight sealing relationhip.

A tubular connecting member 93 on the forward end of the adapter device 91 is shaped to telescopingly receive a similar tubular connecting member 101*a* on the rearward end of the main body 106*a* of tool member 90*a* in order to mount the tool member in operative working position. Since each of the tubular connecting members is symmetrical in cross section, the tool member mounted on the adapter device 91 can be selectively arranged in any one of a number of operative positions. As herein shown, each connecting member is square in cross section, thus permitting a tool member to be positioned in any one of four positions of adjustment with respect to adapter device 91.

Cooperating latch means are preferably provided on each of the connecting members 93, 101*a* so as to firmly, but detachably, retain the tool members in operative position. As herein shown, a small detent 103 is provided on connecting member 101*a* of tool member 90*a*, and is positioned for engagement with any one of the detents or recesses 104 of connecting member 93 so as to releasably lock a selected tool member in any one of four available positions of adjustment.

In addition to providing for angular adjustment of a selected tool member, the adapter device permits a tool member to be changed without the necessity of removing the gun 13 or disconnecting the sand retrieval line 21.

In FIG. 5, a tool member 90*b* is shown which is adapted to abrade surfaces angled inwardly to form an inside corner or similar concave configuration. Tool member 90*b* has a hollow main body with a rear tubular connecting member 101*b* to telescope within the adapter device 91. A sealing member 106*b* is secured to and extends forwardly of the tool member. The resilient sealing member 106*b* has an exposed surface-engaging edge 108*b* shaped on opposite sides to form a pair of straight edge segments joined at their opposite ends by a pair of angled, forwardly protruding elements shaped to fit against surfaces forming an inside corner. The resilient edge 108*b* fits against the inwardly angled surfaces to confine abrasive and debris with the hollow body of the tool during an abrading operation.

Similarly, in FIG. 6, a peripheral edge 108*c* of resilient seal 106*c* is formed with edges angled at 45° on tool 90*c* and joined by a center chord so that it is concave and is adapted for use on outside corners, pipe, I-beams, and other convex or arcuate work surfaces. Seal 106*c* is likewise made of resilient material and is fitted tightly over or adhered to the main hollow body of tool 90*c*. Tubular connecting portion 101*c* telescopes with the housing of adapter device 91.

The symmetrical square connecting members 93, 101*a, b, c,* enable each tool member to be selectively angularly turned so that the exhaust opening 99 for the adapter device 91 can be maintained at the bottom with the tube 98 extending downwardly regardless of the work area against which the tool member is being applied. By angularly adjusting a tool member, the tool member can be moved against surfaces in relatively inaccessible areas.

FIGS. 7 through 23 illustrate additional tool members for normal and specialty abrading of surface areas. The adapter device 91 of the present invention is designed for selected use with any one of these accessory tool members. The abrading device disclosed herein is useful in many situations including removing rust or other materials from metal surfaces such as found on vehicles; preparing metal, plastic or wooden surfaces on the hulls of small boats; de-oxidizing the surfaces of aluminum doors or like articles; removing scaling paint from the side boards of buildings; and preparing surfaces adjacent windows and window frame. Such uses present nearly inaccessible surfaces; and recycling abrading device tools heretofore in use have not adequately abraded and prepared such surfaces.

Each of the eight tool members disclosed in FIGS. 7–23 is attached to the adapter device 91 by structure identical to the structure shown in tool member 90*a* in FIG. 4. Thus each tool member, 90*d*–90*k*, has a corresponding tubular connecting member 101*d*–101*k*, and a corresponding latching detent 103 for cooperation with one of the latching recesses 104 of the adapter device 91. Similarly, each of the eight tool members has a main tubular body, 106*d–k*, having a forward open end portion encircled by a resilient sealing member, 110*d–k*, having an exposed forwardly projecting edge, 108*d–k*, shaped to engage the contour of a surface to be abraded in substantially air-tight sealing relationship. Each sealing member is preferably of rubber, and the resilient nature of this material maintains an air-tight seal and preserves the vacuum within the tool member, by accommodating minor surface variations or contours.

Figure 7:
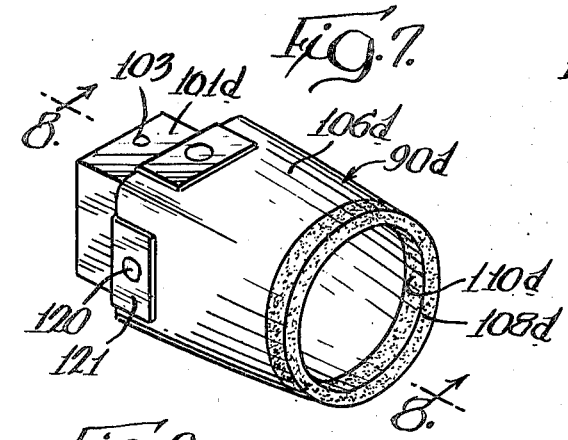
FIG. 7 is a perspective view of a universal tool member having a resiliently flexible main body.
Figure 8:
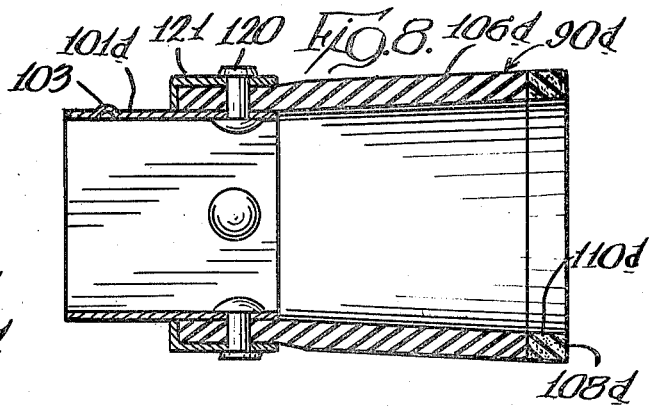
FIG. 8 is a sectional view taken as indicated on line 8—8 of FIG. 7.

Tool member 90*d* FIGS. 7,8) is referred to as a universal tool because of its adaptability for use on many differing surface conditions. The main body is formed of a tough resiliently flexible material (similar to vehicle radiator hose) which has a softer resilient seal member 110*d* adhered to its forward portion. The rigid metal connecting portion 101*d* is secured to the main body 106*d* by a number of rivets 120 which impale peripherally spaced flanges 121 to hold the main body against the connecting portion 101*d*. During use, the material of the main body may be compressed or deformed to form an opening of the desired shape, e.g. oblong, to accommodate the dimensions of the surface being abraded.

Tool member 90*e* (FIGS. 9,10) is referred to as a square tool and is used primarily on large accessible surfaces. The other notable feature of tool 90*e* is the stepped protective seal construction at the forward edge of the adapter tool. The forward edge 108*e* is pressed against the surface to be abraded and is responsible for preserving the vacuum within the interior of the tool member. In order to protect the sealing edge 108*e* during an abrading operation, an inner peripheral shield 124 is provided to deflect abrasive from the sealing edge.

Tool member 90*f* (FIGS. 11, 12, 13) is referred to as an inside corner tool. The sealing member 110*f* is formed from a pair of opposed, space resilient segments 126 joined at each of their opposite ends by a forward protruding angled resilient element 127 shaped to fit against an inwardly angled surface. The segments and angled elements engage the inwardly angled surface to confine abrasive and debris within the hollow main body of the tool member.

Tool member 90*g* (FIGS. 14,15) is designed for performing an abrading operation on the frame about an auto window or in similar conditions. The sealing member 110*g* is formed from a pair of opposed, spaced resilient segments 130 joined at each of their opposite ends by an inwardly extending, angled resilient element 131 shaped to fit against an outwardly angled or convex surface. The segments and angled elements engage the outwardly angled surface to confine abrasive and debris within the hollow main body of the tool member. A stiff reinforcing plate 132 is secured by rivets 133 to one of the segments 130 to restrain that segment against deformation transversely of the axis of the main body of the tool member. For example, when abrading an auto window frame, the reinforcing plate 132 is positioned against the window glass at its juncture with the window frame.

Figure 9:
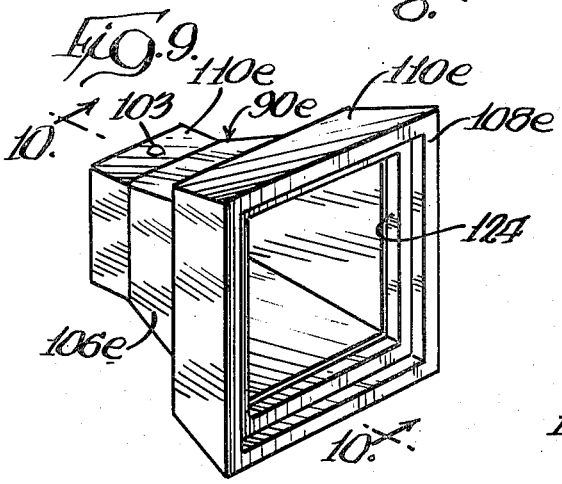
FIG. 9 is a perspective view of a tool member having a square shaped peripheral seal member with an integral inner protective shield.
Figure 10:
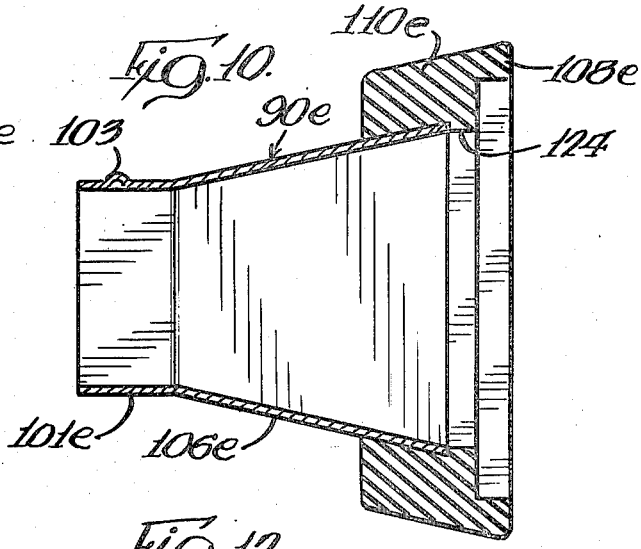
FIG. 10 is a sectional view taken as indicated on line 10—10 of FIG. 9.
Figure 11:
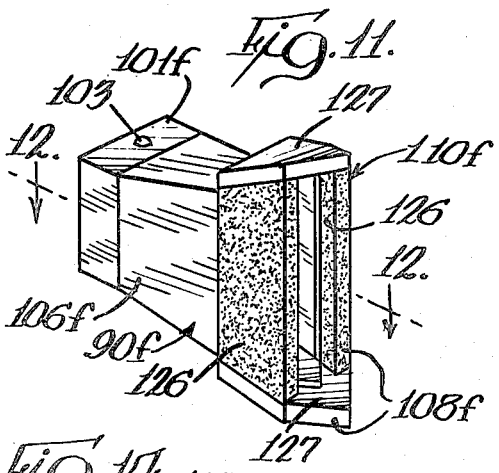
FIG. 11 is a perspective view of a tool member for use on surfaces forming a concave or inside corner area or region.
Figure 12:
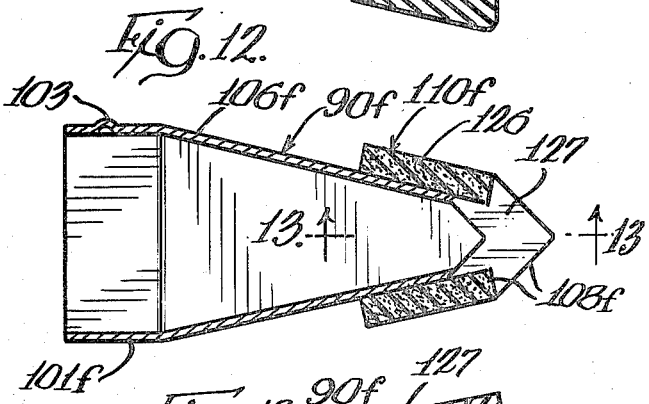
FIG. 12 is a sectional view taken as indicated on line 12—12 of FIG. 11.
Figure 13:
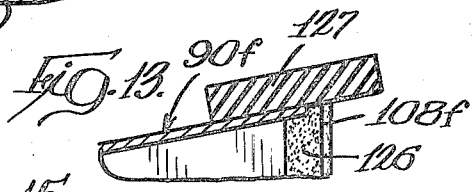
FIG. 13 is a fragmentary sectional view taken as indicated on line 13—13 of FIG. 12.
Figure 14:
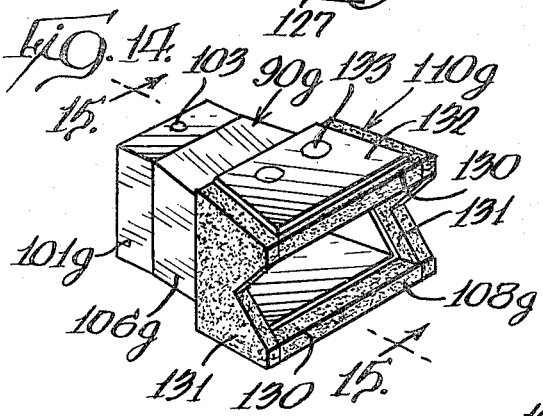
FIG. 14 is a perspective view of a tool member for use on surfaces forming a convex or outside corner area or region.
Figure 15:
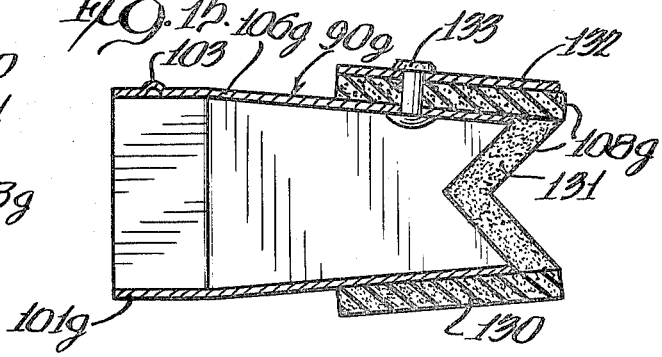
FIG. 15 is a sectional view taken as indicated on line 15—15 of FIG. 14.
Figure 16:
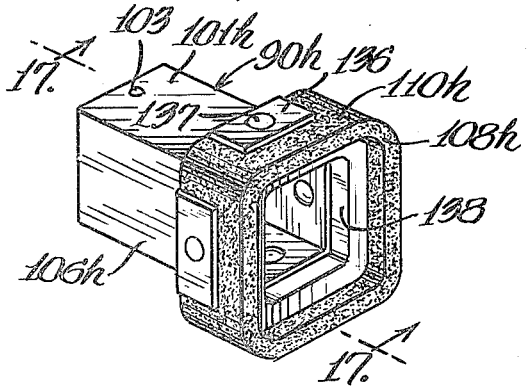
FIG. 16 is a perspective view of a tool member having a seal member with a separate inner protective shield.
Figure 17:
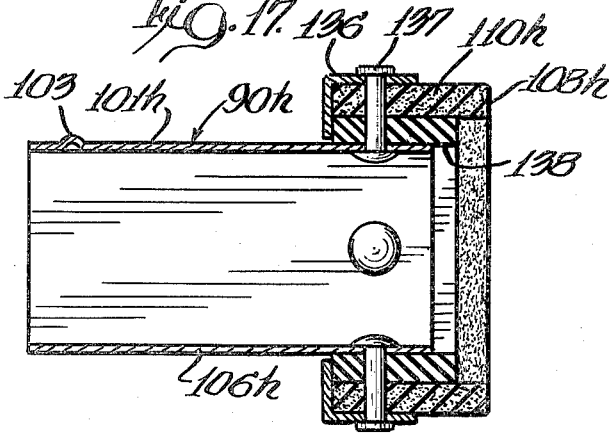
FIG. 17 is a sectional view taken as indicated on line 17—17 of FIG. 16.
Figure 18:
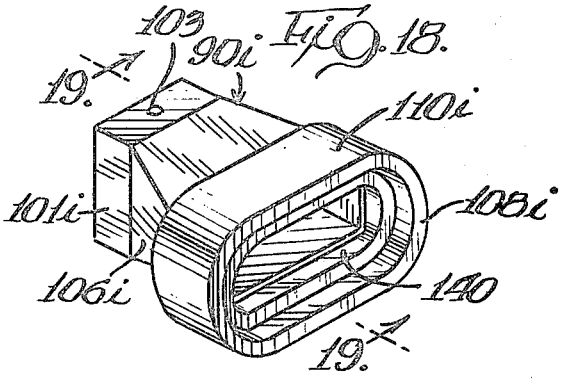
FIG. 18 is a perspective view of a tool member having a forward sealing portion of oblong or rectangular configuration.
Figure 19:
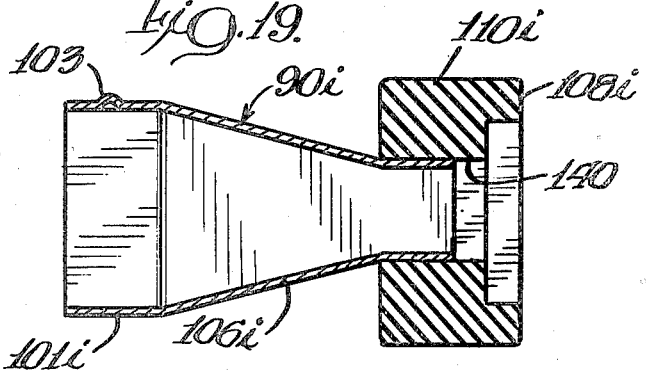
FIG. 19 is a sectional view taken as indicated on line 19—19 of FIG. 18.
Figure 20:
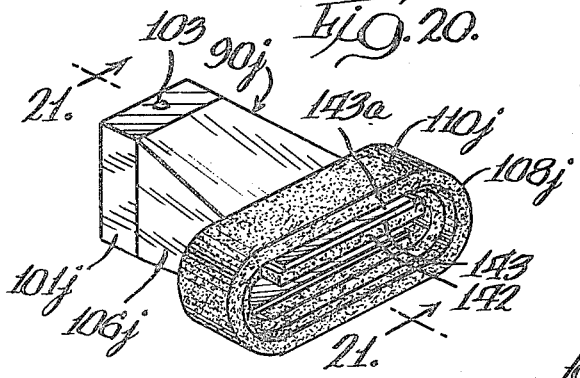
FIG. 20 is a perspective view of a tool member for abrading along the edge of a surface, the tool member having a reinforcing plate positioned on one side of the peripheral seal member.
Figure 21:
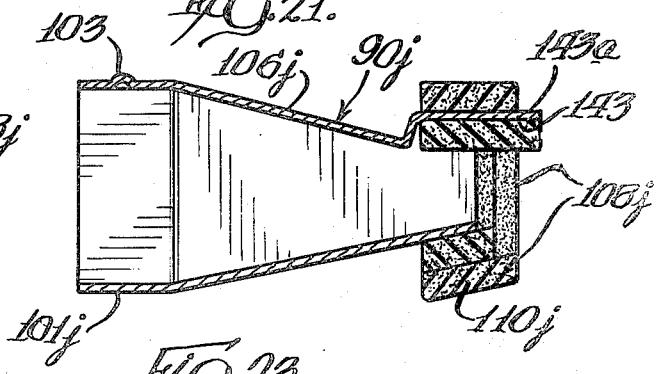
FIG. 21 is a sectional view taken as indicated on line 21—21 of FIG. 20.
Figure 22:
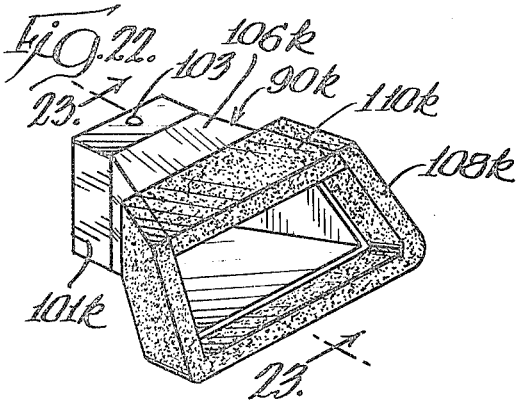
FIG. 22 is a perspective view of a tool member with a wedge-shaped extension having a rectangular cross section for abrading offset substantially flat surfaces.
Figure 23:
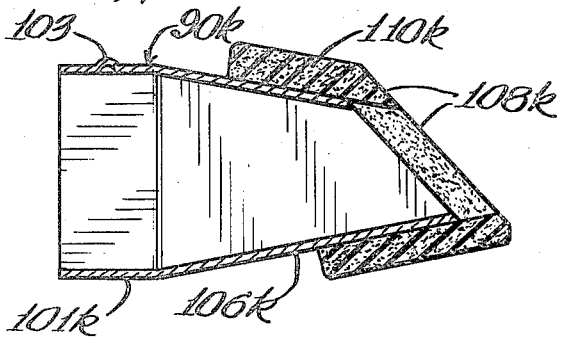
FIG. 23 is a sectional view taken as indicated on line 23—23 of FIG. 22.

Tool member 90*h* (FIGS. 16,17) is simply a small square tool similar to the tool in FIG. 9. Four L-shaped clips 136 are provided with rivets 137 to secure the peripheral seal to the forward end portion of the main body of the tool. A protective peripheral shield 138, comparable to the seal shown in FIG. 9, is spaced inwardly of the sealing member 110*h* for the same reasons as in the structure of FIG. 9.

Tool member 90*i* (FIGS. 18,19) is a so-called rectangular tool. The sealing means 110*i* also includes a protective integral peripheral shield 140 for the reasons discussed in relation to the structure of FIG. 9.

Tool member 90*j* (FIGS. 20,21) is an abrading edge tool. The sealing member 110*j* has an additional length of resilient sealing strip 142 extending forwardly of the sealing edge 108*j*, which strip is reinforced throughout its length with a stiff plate 143. Thus the outside surface 143*a* can be brought to bear against a metal abutment to guide the tool along the abutment during an abrading operation to abrade precisely only the desired surface and to protect adjacent surfaces.

Tool member 90*k* (FIGS. 22,23) is called a rectangular offset tool. The main feature of this tool is that the forwardly exposed edge 108*k* is formed and shaped so as to lie in a plane disposed at an acute angle to the axis of the main body of the tool member, preferably at an angle of approximately 45°. Thus this tool provides access to certain surfaces for abrading that a right-angled tool, such as FIG. 16, will not reach.

The series of tools is designed generally to facilitate the abrading of surfaces that are not readily accessible, as well as accommodating numerous surfaces of varying configurations, such as curves, corners or intricate trims. At the same time, the abrasive is confined internally by the entire system so as to prevent the undesired expulsion of abrasive into the atmosphere, protecting the operator from escaping abrasive as well as permitting the recycling of the spent abrasive and debris, and separation of the same by the abrading device. Importantly, a single adapter device accommodates a plurality of tools, each in any one of a number of preselected positions.

The foregoing description is given for clearness of understanding only and no unnecessary limitations should be implied therefrom, as modifications will be obvious to those skilled in the art.

I claim:

1. In an abrasive blasting system including an abrading device having a housing containing a supply of abrasive material and having an outlet at the bottom thereof, a source of vacuum connected to the housing and applying a negative pressure to the upper surface layer of said abrasive material, a gun having a barrel for directing abrasive material in the direction of a surface area to be abraded and having a passageway therethrough, a source of positive pressure air connected to one end of said gun passageway, a first conduit connected to the housing above said abrasive material for returning abrasive material and abraded debris to the housing, a second conduit having a first end portion connected to the housing outlet and a second end portion connected to said gun passageway downstream of the connection of said source of positive pressure to said gun, and means for causing abrasive material to flow toward the gun in said second conduit, an adapter device for mounting tools for use in the blasting system, comprising:

an adapter housing having a peripheral sidewall enclosed at its rear end portion by a rear end wall and being open at its forward end portion to form a cup-shaped inner chamber;

gun aperture means formed in the rear end wall to receive the barrel of the gun for pivoting movement during a blasting operation;

outlet means in the adapter housing for connection with the first conduit;

a tool member having a hollow main body positioned in axial alignment with the inner chamber of the adapter housing, the main body having oppositely facing open ends, one end being positioned adjacent the forward end portion of the sidewall of the adapter housing, and the other end being exposed forwardly of the main body and being provided with a peripheral seal member shaped to engage the contour of the surface to be abraded;

tubular connecting members on the one end of the body and the forward end portion of the housing sidewall, the connecting members being shaped so that one connecting member is telescopically received within the other connecting member to mount the tool member upon the adapter housing in operative position; and latch means on the tubular connecting members to detachably retain the tool member in operative position.

2. An adapter device as specified in claim 1 in which the peripheral seal member of the tool member is formed of resiliently flexible material and has a forwardly exposed peripheral edge portion for intimately engaging the contour of the surface to be abraded in substantially air-tight sealing relation, said seal member having an inner peripheral shield spaced rearwardly of the exposed edge portion to protect the seal member from abrasion during an abrading operation.

3. The adapter device as specified in claim 1 in which the main body of the tool member is formed of an abrasion-resistant resiliently deformable material and the seal member is formed of a soft foam rubber secured to the deformable material.

4. An adapter device as specified in claim 1 in which the peripheral seal member of the tool member is shaped to fit against an outwardly angled surface to be abraded, the seal member having opposed, spaced, resilient segments, the segments being joined at each of their opposite ends by an inwardly extending angled resilient element shaped to fit against the outwardly angled surface, the resilient segments and elements of the seal member engaging the outwardly angled surface to confine abrasive and debris within the hollow main body of the tool member, and a stiff reinforcing plate is secured lengthwise of one of the resilient segments to restrain said one segment against deformation transversely of the axis of the main body of the tool member.

5. An adapter device as specified in claim 1, in which the other end of the main body converges forwardly to form a flattened portion having an elongated opening, the peripheral seal member being secured about, and extending forwardly of, the flattened portion, said seal member having an elongated resilient segment of one side protruding forwardly of the remainder of the seal member, said segment being provided with a stiff reinforcing plate to restrain the segment against deformation transversely of the axis of the main body of the tool member.

6. An adapter device as specified in claim 1, in which the peripheral seal member of the tool member is formed of resiliently flexible material and has a forwardly exposed peripheral edge portion, said edge portion being shaped so as to lie in a plane disposed at an acute angle to the axis of the main body of the tool member.

7. An adapter device as specified in claim 1, in which the peripheral seal member of the tool member is shaped to simultaneously bear against the surfaces of the opposite sides of the marginal edge of a thin piece of material to be abraded, the seal member having opposed, spaced, resiliently flexible segments, the segments being joined at each of their opposite ends by a resilient element provided with an inwardly extending notched portion, the notched portion terminating in a flattened inner end whereby pressure on the flattened inner end of the notched portion by the piece of material will cause each notched portion to be folded about the marginal edge of said piece of material and will move the segments of the seal member into engagement with the surfaces of the opposite sides of said piece of material.

* * * * *